US006751864B2

(12) United States Patent
Wieres

(10) Patent No.: US 6,751,864 B2
(45) Date of Patent: Jun. 22, 2004

(54) PROCESS AND APPARATUS FOR PRODUCING A METALLIC HONEYCOMB BODY

(75) Inventor: Ludwig Wieres, Overath (DE)

(73) Assignee: Emitec Gesellschaft fuer Emissionstechnologie mbH, Lohmar (DE)

( * ) Notice: Subject to any disclaimer, the term of this patent is extended or adjusted under 35 U.S.C. 154(b) by 70 days.

(21) Appl. No.: 09/962,702

(22) Filed: Sep. 24, 2001

(65) Prior Publication Data

US 2002/0069529 A1 Jun. 13, 2002

Related U.S. Application Data

(63) Continuation of application No. PCT/EP00/01035, filed on Feb. 9, 2000.

(30) Foreign Application Priority Data

Mar. 22, 1999 (DE) ..... 199 12 871

(51) Int. Cl.[7] ..... B23P 15/00
(52) U.S. Cl. ..... 29/890; 29/520
(58) Field of Search ..... 29/890, 515, 516, 29/890.08, 520; 422/180, 179

(56) References Cited

U.S. PATENT DOCUMENTS 5,618,501 A * 4/1997 Wieres et al. ..... 422/180
5,729,902 A * 3/1998 Wieres et al. ..... 29/890
5,960,529 A * 10/1999 Haesemann et al. ..... 29/516
6,317,976 B1 * 11/2001 Aranda et al. ..... 29/890
6,389,693 B1 * 5/2002 Aranda et al. ..... 29/890
2002/0057998 A1 * 5/2002 Foster et al. ..... 422/179

FOREIGN PATENT DOCUMENTS

| | | |
|---|---|---|
| EP | 0 263 324 B1 | 4/1988 |
| WO | WO 97/00135 | 1/1997 |
| WO | WO 97/06358 | 2/1997 |

* cited by examiner

*Primary Examiner*—I Cuda Rosenbaum
(74) *Attorney, Agent, or Firm*—Laurence A. Greenberg; Werner H. Stemer; Ralph E. Locher

(57) ABSTRACT

A process for producing a metallic honeycomb body includes winding, laminating or intertwining at least one at least partly structured layer of sheet metal to form a matrix placed in a tubular jacket. At least the tubular jacket is elastically deformed by successively exerting a substantially linearly and radially inwardly directed force on the peripheral surface of the tubular jacket, as seen in circumferential direction of the tubular jacket. An apparatus for producing a metallic honeycomb body includes at least two mutually movable and variably spaced apart pressure elements for receiving the honeycomb body therebetween and bringing the two pressure elements to bear against the peripheral surface of the tubular jacket, to successively exert a substantially radially inwardly directed force on at least part of the periphery of the tubular jacket for elastically deforming at least the tubular jacket.

4 Claims, 2 Drawing Sheets

PROCESS AND APPARATUS FOR PRODUCING A METALLIC HONEYCOMB BODY

CROSS REFERENCE TO RELATED APPLICATION

This application is a continuation of copending International Application No. PCT/EP00/01035, filed Feb. 9, 2000, which designated the United States.

BACKGROUND OF THE INVENTION

Field of the Invention

The subject matter of the invention relates to a process and an apparatus for producing a metallic honeycomb body.

So-called catalytic converters are used, in particular, for the reduction of certain pollutant components in exhaust gases, especially in exhaust gases of internal combustion engines, preferably spark-ignition engines. A catalytic converter includes a support structure which is provided with a catalytically effective coating. The support structure has a multiplicity of channels through which an exhaust gas can flow. Adhering to the walls of the channels is the catalytically effective coating. The support structure as such has a honeycombed structure.

A honeycomb body is preferably created in the form of a monolithic body. It may be formed of a ceramic material. Honeycomb bodies which are formed of a metallic material are also known. Such honeycomb bodies are produced by sintering or casting.

In particular, metallic honeycomb bodies which include at least partly structured layers of sheet metal are also known in the field of exhaust-gas catalytic converters. One embodiment of such a metallic honeycomb body is described, for example, by European Patent 0 263 324 B1, corresponding to U.S. Pat. No. 4,847,966. The honeycomb body or the matrix is formed by a corrugated metal strip or by a smooth metal strip and a corrugated metal strip. The metal strip or the metal strips are wound or folded into a plurality of layers adjacent one another. European Patent 0 263 324 B1, corresponding to U.S. Pat. No. 4,847,966, shows a spirally wound honeycomb body. The matrix is introduced into a tubular jacket. If appropriate, the honeycomb body is brazed to the tubular jacket. Individual layers of sheet metal may also be soldered to one another during such a soldering operation.

In order to produce a honeycomb body with a multiplicity of fluid-permeable channels from a multiplicity of at least partly structured layers of sheet metal, International Publication No. WO 97/06358, corresponding to U.S. Pat. No. 6,049,980, discloses a process in which a stack is initially formed from a plurality of at least partly structured metal sheets. The stack is introduced into an open mold and held in the latter in a central region by a retaining device. At least two mold segments of the mold are respectively displaced from their initial positions in such a way that at least a partial section of each cover section comes to bear against the stack. Thereafter, the stack is deformed in such a way as to form a matrix. The matrix which is thus formed is introduced into a tubular jacket.

A further process for producing a honeycomb body is described by International Publication No. WO 97/00135, corresponding to U.S. Pat. No. 6,049,961.

During the formation of the matrix, stresses distributed unevenly over the cross section of the matrix form and may lead to the formation of defects. Such defects reduce the strength of the matrix, since the neighboring layers of sheet metal are not soldered to one another in those regions.

That problem occurs to an increased extent in particular if the matrix is formed from layers of sheet metal and those layers have a microstructure, especially a transversal microstructure.

SUMMARY OF THE INVENTION

It is accordingly an object of the invention to provide a process and an apparatus for producing a metallic honeycomb body, which overcome the hereinafore-mentioned disadvantages of the heretofore-known processes and apparatuses of this general type and with which it is possible to reduce defects.

With the foregoing and other objects in view there is provided, in accordance with the invention, a process for producing a metallic honeycomb body, which comprises initially forming a matrix from at least one at least partly structured layer of sheet metal by winding, laminating or intertwining. The matrix which is thus formed is disposed in a tubular jacket. In a further production step, the honeycomb body prepared in this way is subjected to an essentially linear force. The force is directed essentially radially inwardly. The effect of the force on the peripheral surface of the tubular jacket takes place successively. The force is adequate for at least the tubular jacket to be elastically deformed as a result. The honeycomb body is flexed, as it were. This manner of performing the process achieves a stress-free relaxation of the matrix, so that the defects of the matrix are reduced.

In accordance with another mode of the invention, the honeycomb body is disposed between at least two mutually spaced-apart pressure elements. At least one of the pressure elements is driven. The distance between at least two of the at least two pressure elements is variable in relation to one another. The fact that at least one pressure element is driven means that the peripheral surface of the tubular jacket is successively acted upon with the necessary force. The force necessary for the elastic deformation of at least the tubular jacket can be set by varying the distance between the at least two pressure elements.

In accordance with a further mode of the invention, at least one of the pressure elements performs a translational movement. The honeycomb body is preferably disposed between two plate-shaped pressure elements. The plate-shaped pressure elements are moved in relation to and substantially parallel to one another.

In accordance with an added mode of the invention, it is not absolutely necessary for both pressure elements to be moved and therefore only one plate-shaped pressure element is moved, while the other plate-shaped pressure element is disposed in such a way that it is fixed in place. This has the effect of simplifying process control.

In accordance with an additional mode of the invention, the plate-shaped pressure elements are moved in opposite directions. This has the effect of reducing the space requirement or the traveling distance of the pressure elements. This is advantageous, in particular, if the honeycomb body has a relatively large diameter.

In accordance with yet another mode of the invention, at least one of the pressure elements is rotationally moved. In particular, it is proposed that all of the pressure elements are rotationally moved. Simplified process control can be achieved as a result. In particular, the space requirement for carrying out the process is reduced.

In accordance with yet a further mode of the invention, the honeycomb body is disposed between at least three cylindrical pressure elements and the cylindrical pressure elements are rotatable about the respective axes. The axes of the pressure elements preferably lie on the circumference of an imaginary circle. The axes are preferably distributed equidistantly with respect to one another on the circumference of the imaginary circle.

With the objects of the invention in view, there is also provided an apparatus for producing a metallic honeycomb body. The apparatus has at least two pressure elements which are movable relative to one another. The distance between at least two of the at least two pressure elements is variable in relation to one another, so that the pressure elements can be brought to bear against the peripheral surface of the tubular jacket and successively exert an essentially radially inwardly directed force on at least part of the periphery of the tubular jacket, by which at least the tubular jacket can be elastically deformed.

In accordance with another feature of the invention, at least one of the pressure elements is connected to a drive. The force with which the pressure elements act on the peripheral surface of the tubular jacket can be set. If appropriate, corresponding sensors, which measure the force, may be provided on at least one pressure element.

In accordance with a further feature of the invention, at least one of the pressure elements is movable translationally. The pressure elements are preferably constructed in the form of plates and can be moved substantially parallel to one another. The honeycomb body is disposed between these plateshaped pressure elements.

In accordance with a concomitant feature of the invention, the pressure elements are rotationally movable. In particular, it is proposed that the apparatus is formed by at least three cylindrical pressure elements, and the cylindrical pressure elements are rotatable about their respective axis. Other features which are considered as characteristic for the invention are set forth in the appended claims.

Although the invention is illustrated and described herein as embodied in a process and an apparatus for producing a metallic honeycomb body, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
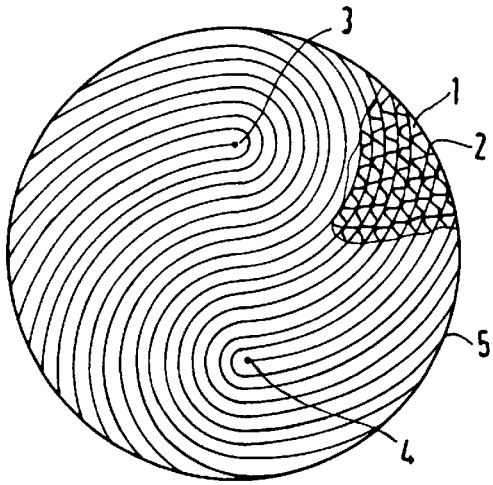
FIG. 1 is a diagrammatic, end-elevational view of a honeycomb body according to the invention.

Referring now to the figures of the drawings in detail and first, particularly, to FIG. 1 thereof, there is seen a diagrammatic view of a honeycomb body which is formed by a matrix and a tubular jacket 5. The matrix is formed by alternating layers of smooth metal sheets 1 and corrugated metal sheets 2. The smooth metal sheets 1 and the corrugated metal sheets 2 are firstly laminated and then intertwined with one another about twisting axes 3, 4. The matrix is subsequently introduced into the tubular jacket 5.

Figure 2:
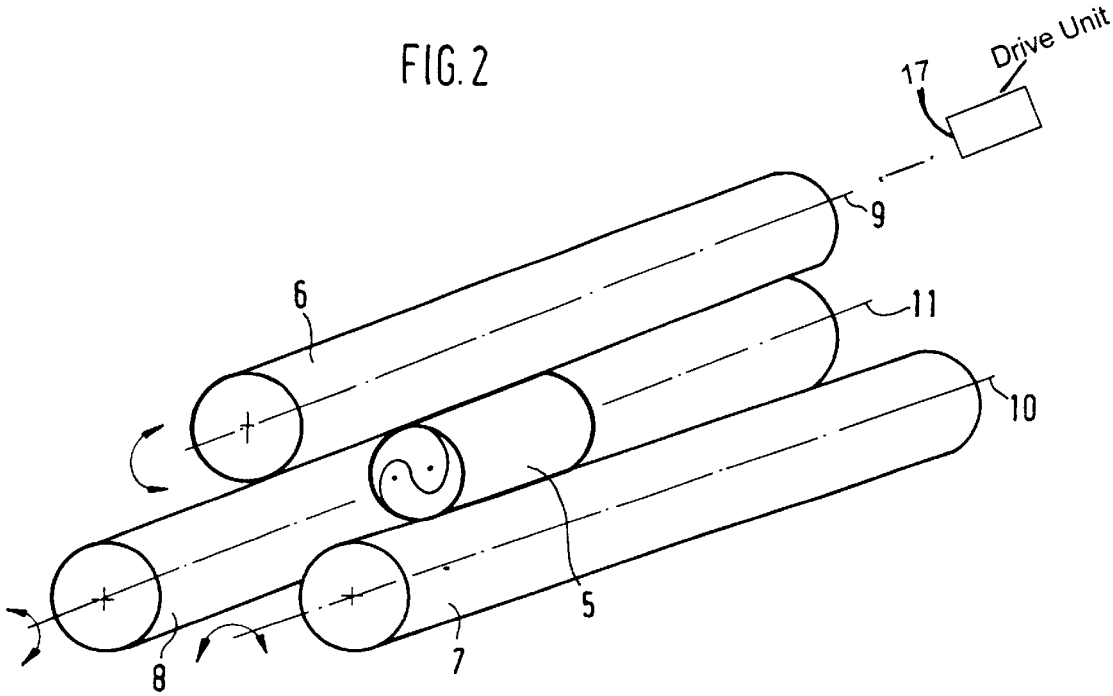
FIG. 2 is a perspective view of a first exemplary embodiment of an apparatus according to the invention for producing a metallic honeycomb body.
Figure 3:
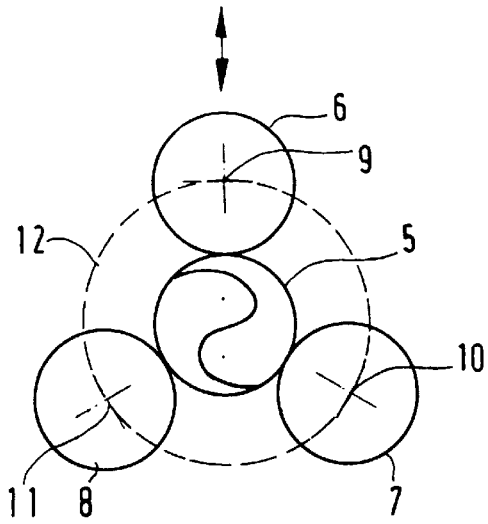
FIG. 3 is a front-elevational view of the apparatus according to FIG. 2.

FIG. 2 diagrammatically shows a first exemplary embodiment of an apparatus for producing a metallic honeycomb body. The apparatus has pressure elements 6, 7, 8, between which the honeycomb body is disposed. The pressure elements 6, 7, 8 have a cylindrical construction. Each pressure element 6, 7, 8 is mounted in such a way that it can rotate about its respective axis 9, 10, 11. At least one of the pressure elements 6, 7, 8 is connected to a drive unit 17. In the illustrated exemplary embodiment, the pressure element 6 is constructed in such a way that it can be moved away from and toward the honeycomb body. The force with which the pressure element 6 presses against the jacket 5 of the honeycomb body can be set in a non-illustrated manner.

The pressure elements 6, 7, 8 are disposed on the circumference of an imaginary circle 12. The pressure elements are also disposed equidistantly with respect to one another.

If a honeycomb body is introduced between the pressure elements 6, 7, 8 and an appropriate force is set, at least one pressure element is set in a rotational movement through the use of the drive unit 17. Linear areas of contact are produced between the pressure elements and the honeycomb body and respectively introduce a radially inwardly directed force at least into the tubular jacket 5, so that at least the tubular jacket 5 is elastically deformed. The rotation has the effect of introducing the force into the tubular jacket successively at different areas, as seen in the circumferential direction of the tubular jacket. The honeycomb body is flexed between the pressure elements.

Figure 4:
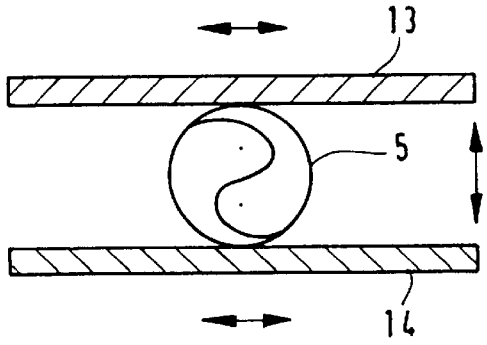
FIG. 4 is a partly-sectional view of a second exemplary embodiment of an apparatus according to the invention for producing a metallic honeycomb body.

FIG. 4 shows a second exemplary embodiment of an apparatus for producing a metallic honeycomb body. A honeycomb body is disposed between two plate-shaped pressure elements 13, 14. The plate-shaped pressure elements 13, 14 are movable in relation to one another, so that a force with which the pressure elements 13, 14 act on the tubular jacket 5 can be set differently. In the exemplary embodiment represented in FIG. 4, the plate-shaped pressure elements 13, 14 can preferably be moved in opposite directions. The apparatus diagrammatically represented in FIG. 4 may also be modified in such a way that only one plate-shaped pressure element is moved. The other plate-shaped pressure element is disposed in such a way that it is fixed in place.

Figure 5:
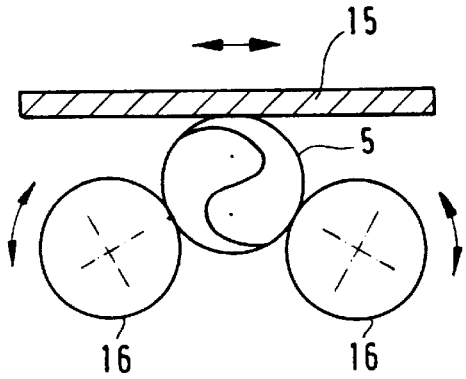
FIG. 5 is a partly-sectional view of a third exemplary embodiment of an apparatus according to the invention for producing a metallic honeycomb body.

FIG. 5 shows yet a further exemplary embodiment of an apparatus. The apparatus includes pressure elements 16, which have a cylindrical construction. An essentially plate-shaped pressure element 15, together with the pressure element 16, forms an intermediate space, into which the honeycomb body is introduced. The pressure elements 15, 16 bear against the circumferential surface of the tubular jacket 5. At least the tubular jacket 5 can be elastically deformed by movement of the plate-shaped pressure element 15 in a plane parallel to the cylindrical pressure elements, so that at least the number of defects in the matrix is reduced.

I claim:

1. A process for producing a metallic honeycomb body, which comprises:

winding, laminating or intertwining at least one at least partly structured layer of sheet metal to form a matrix;

placing the matrix in a tubular jacket having a peripheral surface and a circumferential direction, to form a honeycomb body;

placing the honeycomb body between at least two pressure elements spaced-apart by a mutually variable distance, and rotationally driving at least one of the pressure elements; and elastically deforming at least the tubular jacket by successively exerting a substantially linearly and substantially radially inwardly directed force on the peripheral surface of the tubular jacket, as seen in the circumferential direction of the tubular jacket.

2. The process according to claim 1, which further comprises providing the at least two pressure elements, between which the honeycomb body is placed, as at least three cylindrical pressure elements rotatable about respective axes.

3. A process for producing a metallic honeycomb body, which comprises:

winding, laminating or intertwining at least one at least partly structured layer of sheet metal to form a matrix;

placing the matrix in a tubular jacket having a peripheral surface and a circumferential direction, to form a honeycomb body;

placing the honeycomb body between two plate-shaped pressure elements spaced-apart by a mutually variable distance, and translationally moving the pressure elements relative to and substantially parallel to one another by fixing one of the plate-shaped pressure elements in place and moving the other of the plate-shaped pressure elements; and elastically deforming at least the tubular jacket by successively exerting a substantially linearly and substantially radially inwardly directed force on the peripheral surface of the tubular jacket, as seen in the circumferential direction of the tubular jacket.

4. A process for producing a metallic honeycomb body, which comprises:

winding, laminating or intertwining at least one at least partly structured layer of sheet metal to form a matrix;

placing the matrix in a tubular jacket having a peripheral surface and a circumferential direction, to form a honeycomb body;

placing the honeycomb body between two plate-shaped pressure elements spaced-apart by a mutually variable distance, and translationally moving the pressure elements relative to and substantially parallel to one another by moving the plate-shaped pressure elements in opposite directions; and elastically deforming at least the tubular jacket by successively exerting a substantially linearly and substantially radially inwardly directed force on the peripheral surface of the tubular jacket, as seen in the circumferential direction of the tubular jacket.

* * * * *